US006899483B1

(12) United States Patent
Ho

(10) Patent No.: US 6,899,483 B1
(45) Date of Patent: May 31, 2005

(54) MECHANICAL CRAYON PEN WITH AN INTERNAL CARTRIDGE FOR MULTIPLE CRAYON STICKS

(76) Inventor: Kun-Chuan Ho, No. 58, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/736,565

(22) Filed: Dec. 17, 2003

(51) Int. Cl.[7] ..... B43K 21/02; B43K 5/12; B43K 27/02; B43K 21/00

(52) U.S. Cl. ..... 401/56; 401/192; 401/19; 401/85

(58) Field of Search ..... 401/56, 57, 192, 401/19, 92, 93, 94, 85

(56) References Cited

U.S. PATENT DOCUMENTS 1,296,900 A * 3/1919 Zimdars ..... 401/51
1,575,195 A * 3/1926 Fleming ..... 401/56
2,186,869 A * 1/1940 Kahn ..... 401/52
2,483,103 A * 9/1949 Raimondi ..... 401/78
2,491,254 A * 12/1949 Dorfman ..... 401/78
2,512,273 A * 6/1950 Harvey ..... 401/78
2,563,551 A * 8/1951 Refsdal ..... 401/65
6,116,799 A * 9/2000 Kageyama ..... 401/65

* cited by examiner

*Primary Examiner*—David J. Walczak
(74) *Attorney, Agent, or Firm*—Dennison, Schultz, Dougherty & MacDonald

(57) ABSTRACT

A mechanical crayon pen with an internal cartridge to hold multiple crayon sticks has a transparent barrel (10) with an open top, an inner diameter and an inner surface, a thrust device (20) mounted inside the transparent barrel (10) and a thrust actuator (30) mounted on the open top of the transparent barrel (10). The thrust device (20) has an inner tube (21) movably mounted inside the transparent barrel (10). The inner tube (21) has an outer surface and an outer diameter smaller than the inner diameter of the transparent barrel (10) to form a space (13) in the mechanical crayon pen to store multiple crayon sticks. Multiple longitudinal grooves may be defined in the inner surfaces defining the space (13) to hold individual crayon sticks.

7 Claims, 4 Drawing Sheets

MECHANICAL CRAYON PEN WITH AN INTERNAL CARTRIDGE FOR MULTIPLE CRAYON STICKS

BACKGROUND OF THE INVENTION

1. Field of the Invention

The invention relates to a mechanical crayon pen, and particularly to a mechanical crayon that has an internal cartridge to hold multiple crayon sticks inside so a particular colored crayon can be conveniently and quickly installed in the crayon pen.

2. Description of Related Art

With reference to FIG. 7, a conventional mechanical crayon pen has a barrel (50) and multiple sectional sleeves (52). The barrel (50) has a bottom outlet (not numbered) and a top inlet (not numbered). The multiple sectional sleeves (52) are slidably stacked inside the barrel (50). Each sleeve (52) has a short crayon stick (51) mounted in and protruding from the sleeve (52). Only the sleeve (52) and crayon stick (51) at the bottom outlet of the barrel (50) be seen and used to draw.

The crayon stick (51) is changed by pulling the sectional sleeve (52) at the bottom outlet out of the barrel (50) and pressing it into the top inlet until a desired crayon stick (51) appears at the bottom outlet. The conventional mechanical crayon pen has the following drawbacks:

1. The sectional sleeves (52) with the short crayon sticks (51) are not sold individually. When one of the crayon sticks (51) is used up or one of the sectional sleeves (52) is lost, a complete set of new sectional sleeves (52) with the short crayon sticks (51) must be bought to complete the selection of colors in the conventional mechanical crayon pen. The unused sectional sleeves (52) with the short crayon sticks (51) are a waste for the user.
2. Because the sectional sleeves (52) are stacked inside the barrel (50) in sequence and a specific crayon stick (51) cannot be selected directly, individual sectional sleeves (52) must be removed from and replaced in the barrel (50) one by one until the desired crayon stick (51) appears. Therefore, exposing the desired color stick (51) is troublesome.

Another conventional mechanical crayon pen incorporates features of a mechanical pencil and multiple crayon sticks to change the crayon sticks easily. However, the crayon sticks are stored in a separate case. Hence, the user has to carry the mechanical crayon pen with the separate case of crayon sticks to be able to draw with different colors.

The present invention has arisen to provide a mechanical crayon pen to obviate the foregoing drawbacks of conventional mechanical crayon pens.

SUMMARY OF THE INVENTION

The main objective of the present invention is to provide a mechanical crayon pen with an internal cartridge to hold multiple colored crayon sticks from which a particular colored crayon stick can be conveniently and quickly installed.

Further benefits and advantages of the present invention will become apparent after a careful reading of the detailed description in conjunction with the drawings.

DETAILED DESCRIPTION OF THE PREFERRED EMBODIMENT

Figure 1:
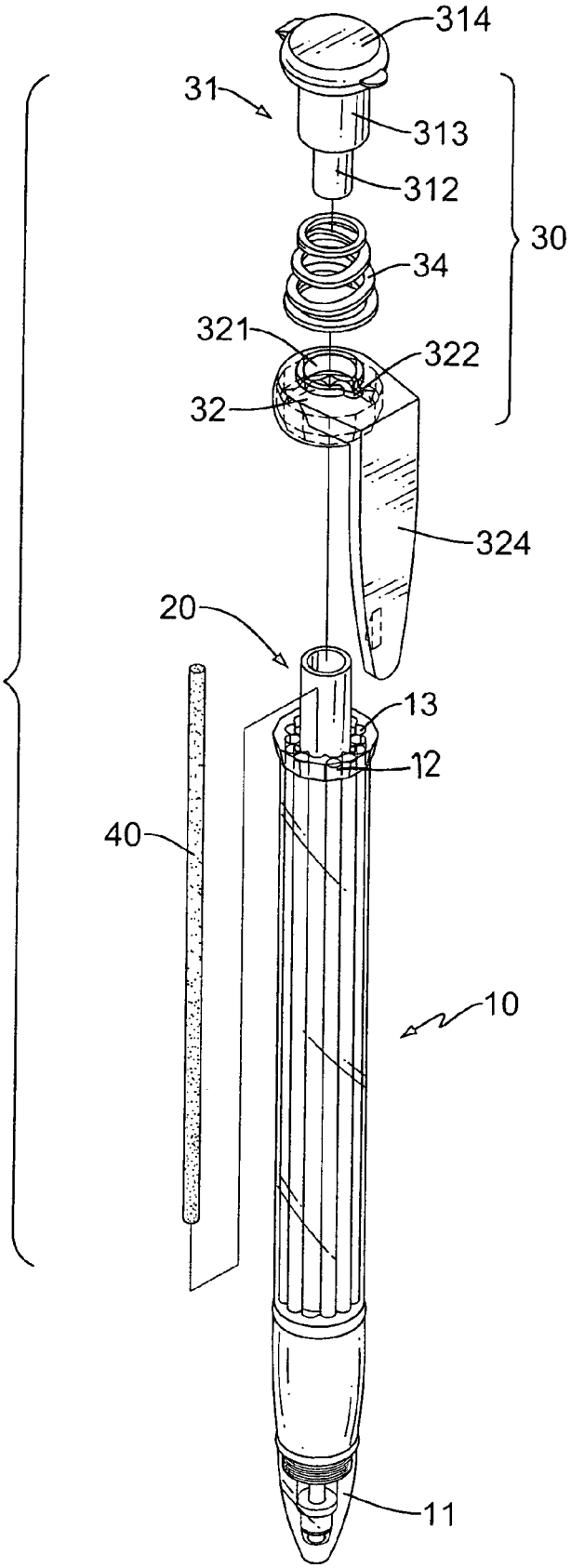
FIG. 1 is an exploded perspective view of a mechanical crayon pen with an internal cartridge for multiple crayon sticks in accordance with the present invention.
Figure 3:
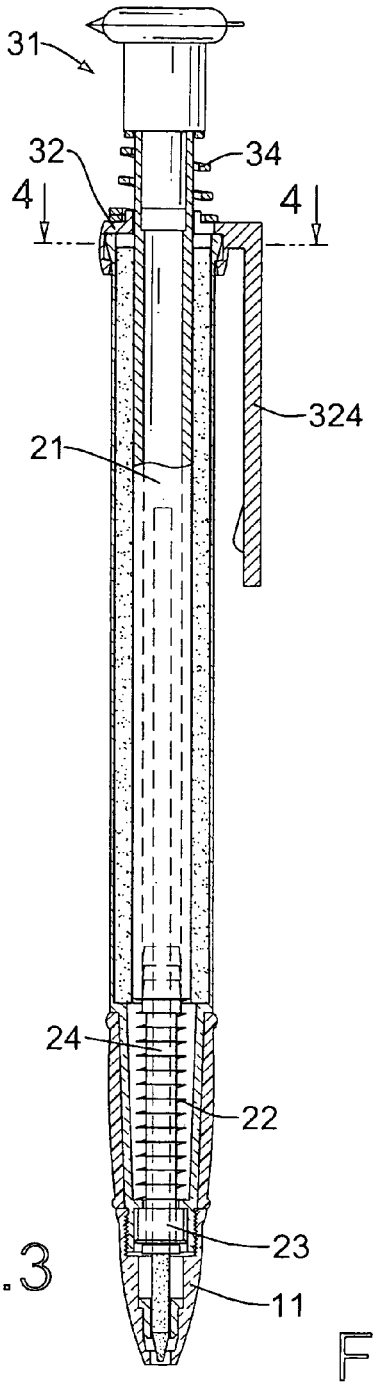
FIG. 3 is a side plane view in partial section of the mechanical crayon pen in combination.
Figure 2:
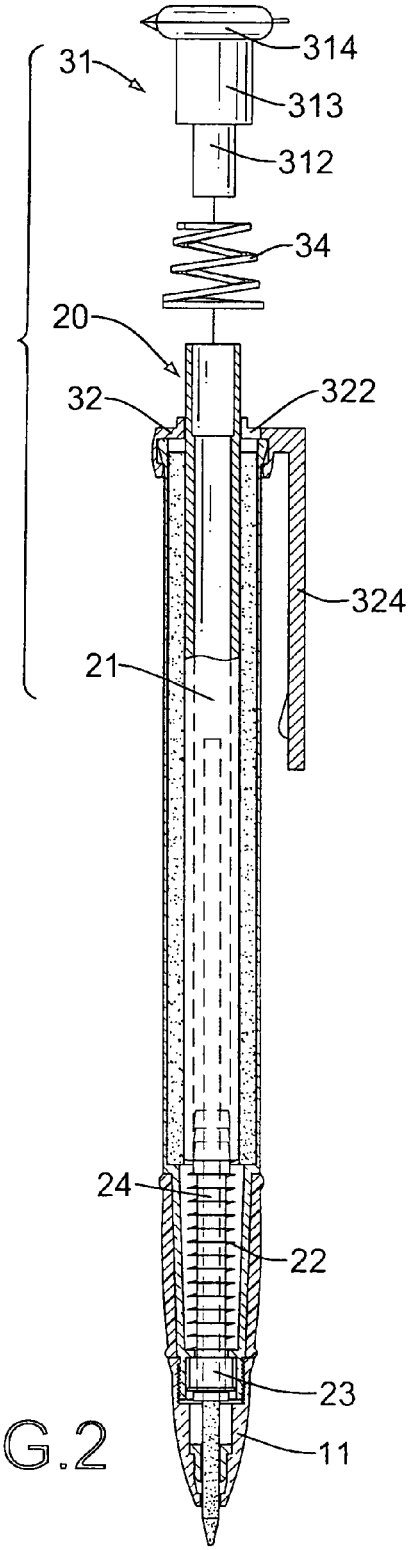
FIG. 2 is a side plan view in partial section of the mechanical crayon pen in FIG. 1.

A mechanical crayon pen with an internal cartridge for multiple crayon sticks comprises a transparent barrel, a thrust device, a thrust actuator and a multiple-crayon cartridge. The transparent barrel has an open top, a bottom tip and an inner surface. The thrust device is mounted inside the transparent barrel, causes an indexed crayon stick to protrude from the transparent barrel and holds the indexed crayon stick in place. The thrust actuator is mounted on the open top of the transparent barrel, and the multiple-crayon cartridge is formed between the transparent barrel and the thrust device.

With reference to FIGS. 1 to 4, an embodiment of the mechanical crayon in accordance with the present invention comprises a transparent barrel (10), a thrust device (20), a thrust actuator (30) and a multiple-crayon cartridge (not numbered) to hold multiple colored crayon sticks (40).

The transparent barrel (10) is a tube with an open top (12), a bottom tip (11), an inner diameter (not numbered), an outer diameter (not numbered) and an inner surface (not numbered). The inner surface may have multiple longitudinal grooves (14) respectively to hold the crayon sticks (40) in place.

The thrust device (20) has an inner tube (21), a hollow shaft (24), a clutch ring (23) and a spring (22) around the hollow shaft (24) near the bottom tip. The inner tube (21) is movably mounted inside the transparent barrel (10), has an outer surface (not numbered), an outer diameter (not numbered), a top end (not numbered) and a bottom end (not numbered) and can hold a single crayon stick (40) inside the inner tube (21). The outer diameter of the inner tube (21) is significantly smaller than the inner diameter of the transparent tube (10) so that a space (13) is formed between the inner surface of the transparent barrel (10) and the inner tube (21). The hollow shaft (24) has a top end and a bottom end and is attached to the inner tube (21) by pressing the top end of the hollow shaft (24) into the bottom end of the inner tube (21). The clutch ring (23) is attached to the bottom end of the hollow shaft (24) and is held in the transparent barrel (10) by the bottom tip (11). The spring (22) is mounted around the hollow shaft (24) between the inner tube (21) and the clutch ring (23) to provide restitution force to the inner tube (21). The clutch ring (23) and its operation are conventional. Therefore, no further descriptions of the structure and operation of the clutch ring (23) are provided.

The thrust actuator (30) is mounted detachably on the open top (12) of the transparent barrel (10) and has a cap (32), a pushbutton (31), and a recoiling spring (34). The cap (32) is a disk and has a top face, a bottom face, a central hole (321), an annular flange (not numbered), an access (322) and an optional clip (324). The central hole (321) is defined in the top face and the access (322) is also defined in the top face to communicate with the central hole (321). The access (322) allows a single colored crayon stick passing through. The annular flange is formed on the bottom face of disk and has an inner diameter slightly smaller than the outer diameter of the transparent barrel (10) so the cap (32) can be detachably and rotatably mounted on the transparent barrel (10). The clip (324) is downward formed at edge of the cap (32) to secure the mechanical crayon pen. The push button (31) is detachably mounted on the cap (32) and has a head (314), a column (313), and an abutting shaft (312). The head (314) is a round disk and the column (313) with a bottom face is attached under the disk. The abutting shaft (312) is attached on the bottom face of the column (313) and protrudes into the inner tube (21). The recoiling spring (34) is mounted around the abutting shaft (312) to cover the access (322) on the cap (32) and provides a restitution force to the push button (31).

Figure 4:
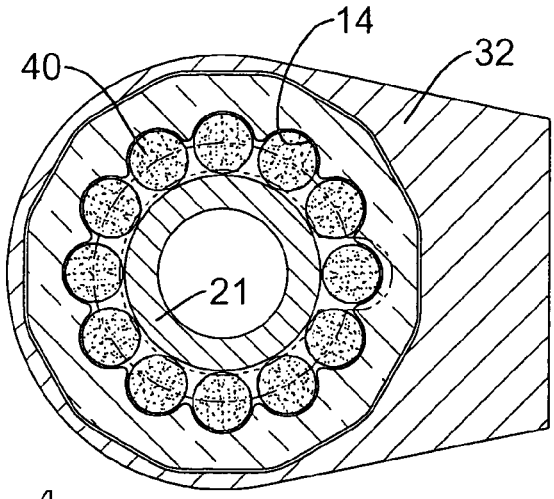
FIG. 4 is a cross-sectional top plan view of the mechanical crayon pen along line 4—4 in FIG. 3.
Figure 5:
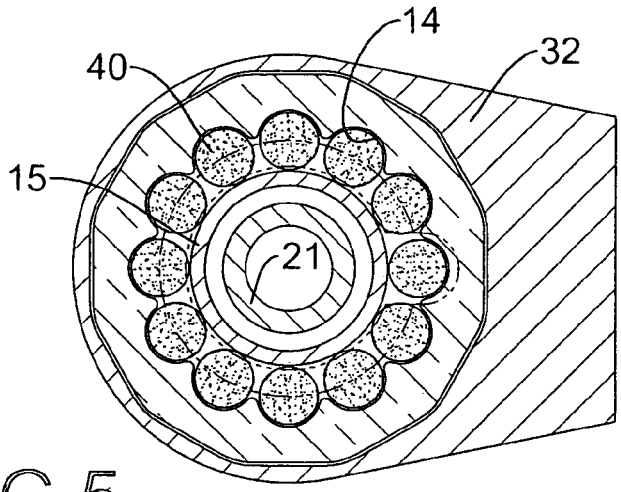
FIG. 5 is a cross-sectional top plan view of another embodiment of the mechanical crayon pen in accordance with the present invention, wherein the mechanical crayon pen further has a dividing wall formed within the internal cartridge.
Figure 6:
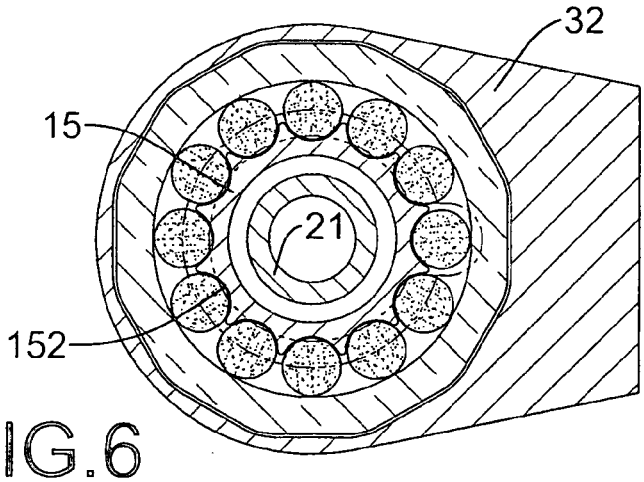
FIG. 6 is a cross-sectional top plan view of still another embodiment of the mechanical crayon pen, wherein the mechanical crayon pen further has a dividing wall formed within the internal cartridge and multiple recesses are defined on an outer surface of the dividing wall.
Figure 7:
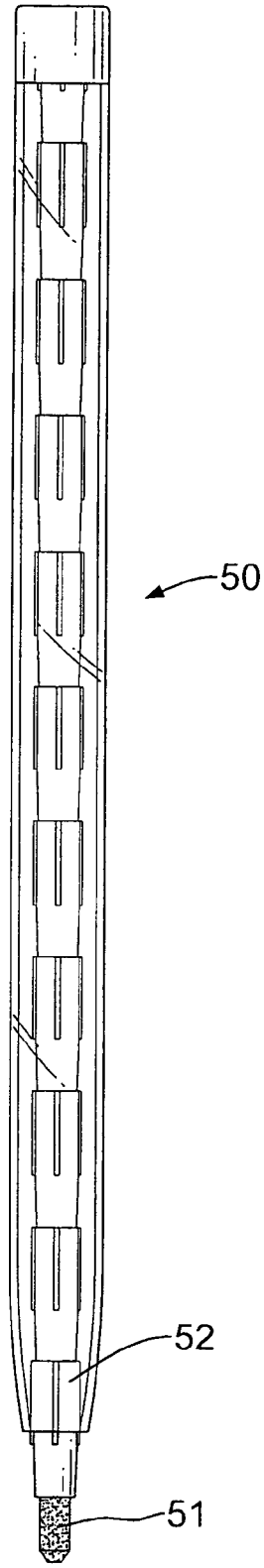
FIG.7 PRIOR ART
FIG. 7 is a side plan view of a conventional mechanical crayon pen in accordance with the prior art.

With reference to FIGS. 4 to 6, the multiple-crayon cartridge comprises the space (13) between the inner surface of the transparent barrel (10) and the outer surface of the inner tube (21) of the thrust device (20) and optional longitudinal grooves (14, 152). In FIG. 4, the optional longitudinal grooves (14) are formed on the inner surface of the transparent barrel (10) to define multiple compartments for individual colored crayon sticks (40). In FIGS. 5 and 6, the mechanical crayon pen in accordance with the present invention further has a dividing wall (15) with an outer surface formed within the space (13) to diminish the compartments to avoid the colored crayon sticks (40) shaking in the cartridge to become scratched or broken. Meanwhile, residuum peeled from the colored crayon sticks (40) is enclosed between the dividing wall (15) and the transparent barrel (10) so that the clutch ring (23) of the thrust device (20) has no chance to be jammed by the residuum. Selectively, the optional longitudinal grooves (14, 152) are formed on the inner surface of the transparent barrel (10) or the outer surface of the dividing wall (15) to defined the multiple compartments. The crayon sticks (40) are stored inside the multiple-crayon cartridge and individually in the 19 optional longitudinal grooves (14, 152) and can be seen through the transparent barrel (10). Therefore, a user can locate the position of a desired color crayon stick (40) and rotate the cap (32) to align the access (322) with the desired color crayon stick (40). The push button (31) and the recoiling spring are detached from the cap (32) to expose the access (322) to allow only the desired color crayon stick (40) to be removed. Then, the desired color crayon strip (40) is installed in the inner tube (21) through the central hole (321) on the cap (32).

Based on the foregoing description, the mechanical crayon in accordance with the present invention has the following advantages:

1. The colored crayon sticks (40) are stored inside the cartridge in the transparent barrel (10), which eliminates the need for a separate crayon case as used with conventional mechanical crayon pens.
2. The colored crayon sticks (40) can be sold individually to satisfy a consumer's requirement for a single colored crayon stick (40).
3. A desired color crayon stick (40) can be selected and taken out of the mechanical crayon pen through the access (322) on the cap (32) and conveniently and quickly loaded into the inner tube (21).

Although the invention has been explained in relation to its preferred embodiment, many other possible modifications and variations can be made without departing from the spirit and scope of the invention as hereinafter claimed.

What is claimed is:

1. A mechanical crayon pen with an internal cartridge for multiple crayon sticks comprising:

a transparent barrel (10) having an open top (12), a bottom tip (11), an inner diameter, an outer diameter and an inner surface;

multiple longitudinal grooves (14) are defined on the inner surface of the transparent barrel (10);

a thrust device (20) mounted inside the transparent barrel (10) and having an inner tube (21) movably mounted inside the transparent barrel (10), wherein the inner tube (21) has an outer surface, a top end, a bottom end and an outer diameter smaller than the inner diameter of the transparent tube (10) so that a space (13) is formed between the transparent barrel (10) and the inner tube (21) to hold the multiple crayon sticks;

a hollow shaft (24) having a top end pressed into the bottom end of the inner tube (21) and a bottom end;

a clutch ring (23) mounted at the bottom end of the hollow shaft (24) and accommodated at the bottom tip (11) in the transparent barrel (10); and a spring (22) mounted around the shaft (24) between the bottom end of the inner tube (21) and the clutch ring (23); and a thrust actuator (30) detachably mounted on the open top (12) of the transparent barrel (10) and having a cap (32) with a central hole (321) rotatably mounted on the open top (12) of the transparent barrel (10); and a pushbutton (31) detachably and movably mounted on the cap (32) to push the inner tube (21) downward.

2. The mechanical crayon pen with an internal cartridge for multiple crayon sticks as claimed in claim 1, wherein the push button (31) has:

a head (314);

a column (313) with a bottom face attached under the head (314);

an abutting shaft (312) formed on the bottom face of the column and protruding into the inner tube (21) to push the inner tube (21) downward; and a recoiling spring (34) mounted around the abutting shaft (312).

3. The mechanical crayon pen with an internal cartridge to hold multiple crayon sticks as claimed in claim 1, wherein the push button (31) has:

a head (314);

a column (313) with a bottom face attached under the head (314);

an abutting shaft (312) formed on the bottom face of the column and protruding into the inner tube (21) to push the inner tube (21) downward; and a recoiling spring (34) mounted around the abutting shaft (312).

4. The mechanical crayon pen with an internal cartridge to hold multiple crayon sticks as claimed in claim 1, wherein the mechanical crayon pen further has a dividing wall (15) formed within the space (13).

5. The mechanical crayon pen with an internal cartridge to hold multiple crayon sticks as claimed in claim 4, wherein the dividing wall (15) has an outer surface and multiple longitudinal grooves (152) are defined on the outer surface of the inner tube (21).

6. The mechanical crayon pen with an internal cartridge to hold multiple crayon sticks as claimed in claim 5, wherein the cap (32) further has an access (322) formed in the cap (21) over the space (13) and a clip (324) extending downward from edge of the cap (32).

7. The mechanical crayon pen with an internal cartridge to hold multiple crayon sticks as claimed in claim 1, wherein the mechanical crayon pen further has a dividing wall formed within the space (13).

* * * * *